US006866070B2

(12) United States Patent
King et al.

(10) Patent No.: US 6,866,070 B2
(45) Date of Patent: Mar. 15, 2005

(54) BAG INSERT AND SUPPORT

(75) Inventors: Patrick F. King, Glen Ellyn, IL (US); Myron P. Andersen, Glen Ellyn, IL (US)

(73) Assignee: Glen Ellyn Industries LLC, Glen Ellyn, IL (US)

( * ) Notice: Subject to any disclaimer, the term of this patent is extended or adjusted under 35 U.S.C. 154(b) by 0 days.

(21) Appl. No.: 10/630,600

(22) Filed: Jul. 30, 2003

(65) Prior Publication Data

US 2004/0026578 A1 Feb. 12, 2004

Related U.S. Application Data

(60) Provisional application No. 60/401,978, filed on Aug. 8, 2002.

(51) Int. Cl.[7] ..... B05B 1/06

(52) U.S. Cl. ..... 141/10; 141/337; 141/391

(58) Field of Search ..... 141/331, 337, 141/390, 391, 10; 248/95, 99, 152; 229/117.01, 117.05, 117.06, 117.35

(56) References Cited

U.S. PATENT DOCUMENTS

| | | | | | |
|---|---|---|---|---|---|
| ,711,410 | A | | 10/1902 | Means | 220/9.1 |
| ,725,538 | A | | 4/1903 | Brown | 248/101 |
| ,754,580 | A | | 3/1904 | Madden et al. | 248/98 |
| ,967,368 | A | | 8/1910 | Grigsby | 248/153 |
| 1,124,091 | A | | 1/1915 | Willoughby | 248/99 |
| 1,162,575 | A | | 1/1915 | Craig | 248/153 |
| 1,278,385 | A | | 9/1918 | Rickard | 248/94 |
| 2,113,153 | A | | 4/1938 | Jonassen | 248/101 |
| 2,304,810 | A | | 12/1942 | Fetterman | 248/153 |
| 2,399,498 | A | | 4/1946 | Messick | 248/156 |
| 2,401,969 | A | | 6/1946 | Schlank | 223/95 |
| 2,488,782 | A | | 11/1949 | Schultheiss | 248/101 |
| 2,513,461 | A | | 7/1950 | Duncan, Jr. | 248/154 |
| 2,673,053 | A | | 3/1954 | Kilian | 248/153 |
| 2,706,517 | A | | 4/1955 | Dexter | 297/188.2 |
| 2,809,760 | A | | 10/1957 | Clark | 215/11.6 |
| 3,100,076 | A | * | 8/1963 | Russell | 383/10 |
| 3,211,404 | A | | 10/1965 | Edmiston | 248/154 |
| 3,276,733 | A | | 10/1966 | Rosser | 248/146 |
| 3,627,242 | A | | 12/1971 | Vandermast | 248/97 |
| 3,688,484 | A | | 9/1972 | Cox | 56/400.12 |
| 3,754,785 | A | | 8/1973 | Anderson | 294/19 R |
| 3,796,402 | A | | 3/1974 | Trotta | 248/97 |
| 3,893,699 | A | | 7/1975 | Morris | 280/34 B |
| 3,934,803 | A | | 1/1976 | Paulus, Jr. | 294/1.1 |
| 3,936,087 | A | | 2/1976 | Alexander | 294/1.1 |
| 3,958,785 | A | | 5/1976 | Aboud | 291/1.1 |
| 3,995,744 | A | | 12/1976 | Metcalf | 211/131 |
| 4,037,778 | A | * | 7/1977 | Boyle | 141/390 |
| 4,202,521 | A | | 5/1980 | Harding | 248/98 |
| 4,287,701 | A | | 9/1981 | Washington | 53/390 |
| 4,291,798 | A | | 9/1981 | Transport | 206/45.24 |
| 4,358,083 | A | | 11/1982 | Haubrich | 248/545 |
| 4,440,430 | A | | 4/1984 | Kruse | 294/1.1 |

(List continued on next page.)

*Primary Examiner*—Gregory L. Huson
*Assistant Examiner*—Peter deVore
(74) *Attorney, Agent, or Firm*—Withrow & Terranova, PLLC

(57) ABSTRACT

The bag insert of the present invention is an apparatus for aiding in the management of a waste collection bag during waste collection. In one embodiment, the bag insert is placed inside the waste collection bag and then expanded. Once expanded, the bag insert maintains the bag in an upright and open position. Further, the bag insert forms a hollow rectangular tube such that waste can be placed inside the bag by dropping the waste through the open top of the bag insert. The waste collection bag may be placed inside the expanded bag insert, wherein the bag insert maintains the bag in an upright and substantially open position. After waste collection is complete, the bag insert is capable of being folded along several axes such that the size of the bag insert is reduced for storage.

8 Claims, 11 Drawing Sheets

U.S. PATENT DOCUMENTS

| | | | | | |
|---|---|---|---|---|---|
| 4,445,658 | A | | 5/1984 | Ferron | 248/99 |
| 4,457,483 | A | | 7/1984 | Gagne | 248/97 |
| 4,458,932 | A | | 7/1984 | Resch | 294/1 B |
| 4,530,533 | A | | 7/1985 | Dieter | 294/1.1 |
| 4,537,376 | A | | 8/1985 | Buku | 248/97 |
| 4,575,895 | A | | 3/1986 | Spellman | 15/327 |
| 4,669,690 | A | | 6/1987 | McEniry | 248/101 |
| 4,708,307 | A | | 11/1987 | Daigle | 248/97 |
| 4,749,011 | A | | 6/1988 | Rylander | 141/316 |
| 4,760,987 | A | | 8/1988 | Lan | 248/346.1 |
| 4,773,660 | A | | 9/1988 | Trubiano | 280/33.99 |
| 4,815,866 | A | | 3/1989 | Martone | 383/34.1 |
| 4,884,603 | A | | 12/1989 | Simpson | 141/390 |
| 4,890,652 | A | * | 1/1990 | Hoerner | 141/10 |
| 4,901,959 | A | | 2/1990 | Stage | 248/97 |
| 4,955,505 | A | | 9/1990 | Battaglia | 220/495.07 |
| 4,979,547 | A | | 12/1990 | Hoerner | 141/390 |
| 4,991,386 | A | | 2/1991 | Dirksen | 56/400.12 |
| 5,018,637 | A | * | 5/1991 | Miller | 229/117.35 |
| 5,022,767 | A | | 6/1991 | Cardulla | 383/33 |
| 5,058,839 | A | | 10/1991 | Stevens | 248/97 |
| 5,065,965 | A | | 11/1991 | Aulabaugh | 248/99 |
| 5,069,405 | A | | 12/1991 | Keating | 248/98 |
| 5,129,609 | A | | 7/1992 | Tobin | 248/97 |
| 5,139,219 | A | | 8/1992 | Navarro | 248/97 |
| 5,193,770 | A | | 3/1993 | Kildare | 248/97 |
| 5,195,765 | A | | 3/1993 | Lacey, Jr. | 280/47.26 |
| 5,222,704 | A | | 6/1993 | Light | 248/100 |
| 5,263,672 | A | | 11/1993 | He | 248/97 |
| 5,316,609 | A | | 5/1994 | Guither et al. | 156/301 |
| 5,397,085 | A | | 3/1995 | Spagnolo | 248/97 |
| 5,425,468 | A | * | 6/1995 | Birkel et al. | 220/495.11 |
| 5,445,398 | A | | 8/1995 | Pierce | 280/47.26 |
| 5,456,431 | A | | 10/1995 | Ilnisky | 248/98 |
| 5,593,117 | A | | 1/1997 | Alexander, III | 248/99 |
| 5,597,117 | A | | 1/1997 | Watanabe et al. | 236/92 B |
| 5,857,722 | A | | 1/1999 | Ayotte | 294/1.1 |
| 5,897,084 | A | * | 4/1999 | Judge | 248/95 |
| 5,924,657 | A | | 7/1999 | Bach | 248/97 |
| 6,131,861 | A | | 10/2000 | Fortier, Jr. | 248/98 |
| 6,296,212 | B1 | | 10/2001 | Monahan | 248/99 |
| 6,367,747 | B1 | * | 4/2002 | Mulle | 248/99 |
| 6,536,488 | B1 | | 3/2003 | Pochobradsky | 141/390 |

* cited by examiner

BAG INSERT AND SUPPORT

RELATED APPLICATION

This patent application claims priority to U.S. Provisional Patent Application Ser. No. 60/401,978 filed on Aug. 8, 2002 which is incorporated herein by reference in its entirety.

FIELD OF THE INVENTION

The present invention deals with an apparatus to aid in the management and usability of collection bags for waste collection.

BACKGROUND OF THE INVENTION

Yard waste removal has long been a task completed by homeowners all over the world. In many areas, yard waste, such as leaves and grass clippings, is considered to be recyclable material and is therefore directed to compost facilities. Many cities and municipalities will dispose of yard waste separately than normal trash for recycling. However, the yard waste is typically required to be stored in a special waste collection bag for pickup. Hardware and convenience stores generally sell paper yard waste collection bags that are compliant with the regulations governing such disposal and recycling of yard waste. When using these paper yard waste collection bags, several problems and annoyances come to light. Just as any waste bag, these paper yard waste collection bags are difficult to open and to hold open during waste collection and deposit into the bag.

There are many existing apparatuses for aiding in the management of waste collection bags. Some of these are described in detail in U.S. Pat. Nos. 6,296,212 to Monahan, 6,131,861 to Fortier et al., 5,857,722 to Ayotte, and 5,924,657 to Bach. The apparatuses disclosed by Monahan, Fortier, Ayotte, and Bach each has deficiencies. Monahan discloses a flexible flat device that forms an arc to hold open a lawn bag in a horizontal direction when flexed and placed inside the lawn bag. The lawn bag is typically laid on the ground and the waste is swept into the bag. Further, the device disclosed in Monahan is large by nature cannot be conveniently stored when not in use. In addition, the device disclosed in Monahan is made with a material that does not comply with common recycling regulations.

Fortier discloses an apparatus that holds a cylindrical bag in a vertical position, and can be moved using a vertical member having a handle and two wheels. The device in Fortier does not guarantee that the lawn bag is forced completely open, thereby forcing a user to place an object into the inside of the bag to spread out the bag for filling. Also, the wind will cause the hanging bag to move at the bottom making it more difficult to fill the bag.

Ayotte discloses a device having a rigid frame that holds a lawn bag in an upright open position. The device is stabilized by driving legs that attach the device into the ground.

Fortier, Ayotte, and Bach each disclose devices that are not suitable to be used with the common paper waste collection bags. These devices are intended for use with cylindrical plastic bags, and do not themselves comply with common recycling regulations. Further, the devices disclosed by Fortier and Ayotte are relatively expensive and require significant storage space. Thus, there remains a need for an apparatus to aid in the management of paper waste collection bags that is recyclable, requires a minimum amount of storage space, and is inexpensive.

SUMMARY OF THE INVENTION

The bag insert of the present invention is an apparatus for aiding in the management and usability of a waste collection bag during waste collection. The bag insert is particularly useful for use with yard waste collection bags.

The bag insert is placed inside the yard waste collection bag and then expanded. Once expanded, the bag insert maintains the bag in an upright and open position. Further, the bag insert forms a hollow rectangular tube such that yard waste can be placed inside the bag by dropping the yard waste through the open top of the bag insert. After yard waste collection in complete, the bag insert is capable of being folded along several axes for easy folding so that the size of the bag insert is reduced for storage. In addition to being folded, the bag insert comprises handles, which aid the maneuvering and carrying of the bag insert, whether inside a collection bag or not.

Alternatively, a waste collection bag may be placed inside the bag insert instead of placing the bag insert inside the waste collection bag such that the waste collection bag is supported within the bag insert. Once the bag insert is expanded, the waste collection bag is placed inside the bag insert, and the waste collection bag is maintained in an upright and substantially open position. After waste collection is complete, the bag insert is capable of being folded along several axes for easy folding so that the size of the bag insert is reduced for storage. In addition to being folded, the bag insert comprises handles, which aid the maneuvering and carrying of the bag insert, whether inside a collection bag or not. All of the other features of the bag insert are equally applicable.

In a first embodiment of the present invention, the bag insert has two vertical axes around which the bag insert is capable of being folded such that the overall width of the bag insert is reduced.

In a second embodiment, the bag insert has two vertical axes and a horizontal axis around which the bag insert is capable of being folded such that the overall width and length of the bag insert is reduced in two planes.

In a third embodiment, the bag insert has three vertical axes around which the bag insert is capable of being folded such that the overall width of the bag insert is further reduced.

In a fourth embodiment, the bag insert has three vertical axes and a horizontal axis around which the bag insert is capable of being folded such that the overall width and length of the bag insert is reduced in two planes further.

Multiple handle arrangements may be provided for easy carrying and movement of the bag insert.

The bag insert may also contain attachment members that allow the bag to be physically attached to the outer walls of the bag insert for further assurance that the bag will remain in an upright, open position.

The bag insert may also include a number of pegs located at the bottom of the bag insert that stabilize the bag insert when set upright. The pegs allow the bag insert to be anchored into the ground and/or distribute weight onto each of the pegs.

The bag insert may also include first, second, third, and fourth foldable bottom members that when folded form a bottom side of the bag insert.

Additional embodiments can be realized by using different materials, such as cardboard, recycled paper, or plastic, to manufacture the aforementioned embodiments.

DETAILED DESCRIPTION OF THE INVENTION

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

This patent application claims priority to U.S. Provisional Patent Application Ser. No. 60/401,978, filed on Aug. 8, 2002, which is incorporated herein by reference in its entirety.

Figure 1:
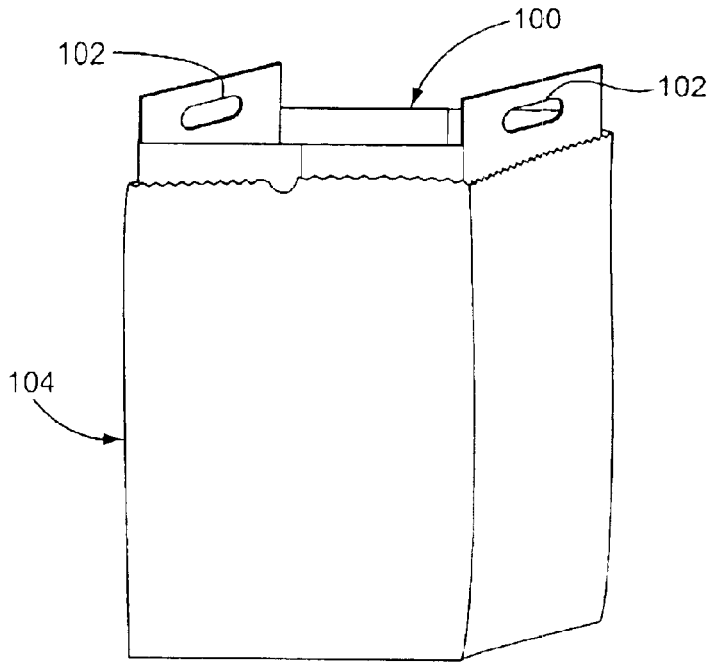
FIG. 1 illustrates the preferred embodiment of the present invention having been expanded inside a yard waste collection bag.

FIG. 1 illustrates the preferred embodiment of the present invention. A bag insert 100 is provided that contains handles 102 for carrying the bag insert 100. Although the top corners of the handles 102 are illustrated as being essentially right angles, the top corner of the handles 102 may also be rounded. The bag insert 100 is illustrated in FIG. 1 in its expanded position inside a yard waste collection bag 104. When expanded, the bag insert 100 holds the bag 104 in the open position, wherein the bag 104 can be partially or fully open. Further, the length of the bag insert 100 is substantially equal to or greater than the length of the yard waste collection bag 104, and is therefore capable of stabilizing the bag 104 in the upright open position during use. In order to remove the bag insert 100 from the bag 104, the bag insert 100 will be simply lifted upward and directly out, easily sliding out of the bag 104 using the handles 102. The handles 102 provide a convenient way for the bag insert 100 to be placed into and removed from the yard waste collection bag 104 and carried when not inserted into the bag 104.

Figure 2:
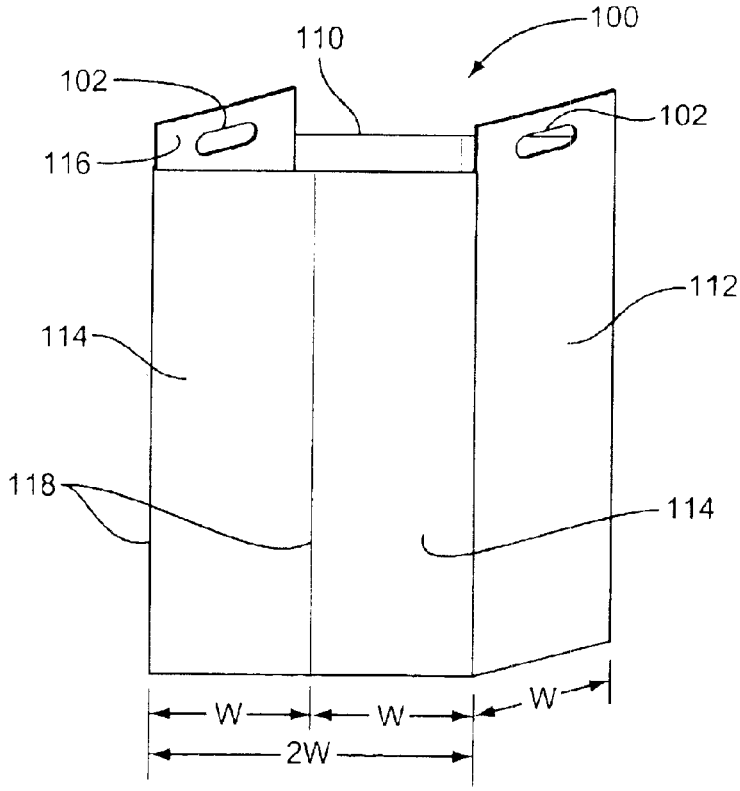
FIG. 2 illustrates the preferred embodiment of the present invention being in the expanded position.

FIG. 2 illustrates the bag insert 100 of the present invention in its expanded position. Unlike FIG. 1, the bag insert 100 illustrated in FIG. 2 is not shown as being inserted into the yard waste collection bag 104. In this embodiment, the bag insert 100 has four sides 110, 112, 114, and 116. Sides 112 and 116 both have handles 102 and are both slightly longer in length than sides 110 and 114. Additionally in this embodiment, the sides 110 and 114 have widths substantially equal to twice the widths of sides 112 and 116. Sides 110, 112, 114, and 116 provide the bag insert 100 with a hollow rectangular shape, meaning the bag insert 100 does not have a closed top or bottom. This hollow rectangular shape allows yard waste to be dropped into and through the bag insert 100 so that the waste falls into the yard waste collection bag 104. The longer length of the sides 112 and 116 ensures that the handles 102 are unobstructed when the bag insert 100 is folded along two vertical axes 118. One of the two vertical axes is found at the intersection of sides 114 and 116. In another embodiment, this axis could be at the intersection of sides 112 and 114. The second vertical axis 118 is found on side 114. In the preferred embodiment, the vertical axis 118 on side 114 is found at a distance equal to half the width of side 114 from the edge of side 114.

Further, the bag insert 100 is preferably capable of collapsing such that it is flat and substantially in one-dimension, thereby allowing the bag insert 100 to be easily maneuvered and stored. The bag insert 100 is preferably manufactured with recycled paper in order to be compliant with common waste management regulations.

Figure 3:
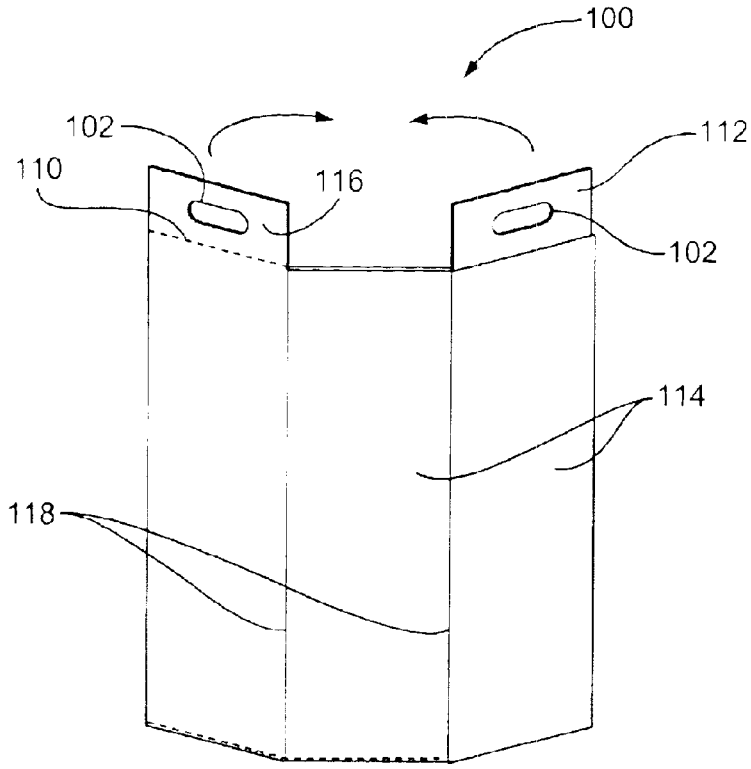
FIG. 3 illustrates the preferred embodiment of the present invention being folded along two vertical axes.

FIG. 3 illustrates an embodiment of the present invention being folded along two vertical axes 118. In order to reduce the size of the bag insert 100 before packaging for sale or storage, the bag insert 100 has the vertical axes 118 located on sides 114 and at the intersection of sides 114 and 116 so that the bag insert 100 can be folded around the vertical axes 118 when in its collapsed position. The handles 102 are positioned on the sides 112 and 116 such that they align with each other unobstructed after the bag insert 100 has been folded along the vertical axes 118. The bag insert 100 can be folded in this manner since the bag insert 100 is manufactured out of a flexible material, such as recycled paper or cardboard. The bag insert's 100 ability to be folded along the vertical axes 118 allows the bag insert 100 to be easily maneuvered, stored, and inserted into a yard waste collection bag 104. After the bag insert 100 is placed inside a bag 104, the bag insert 100 is expanded to hold the bag 104 in an upright and open position, as illustrated in FIG. 1.

Figure 4:
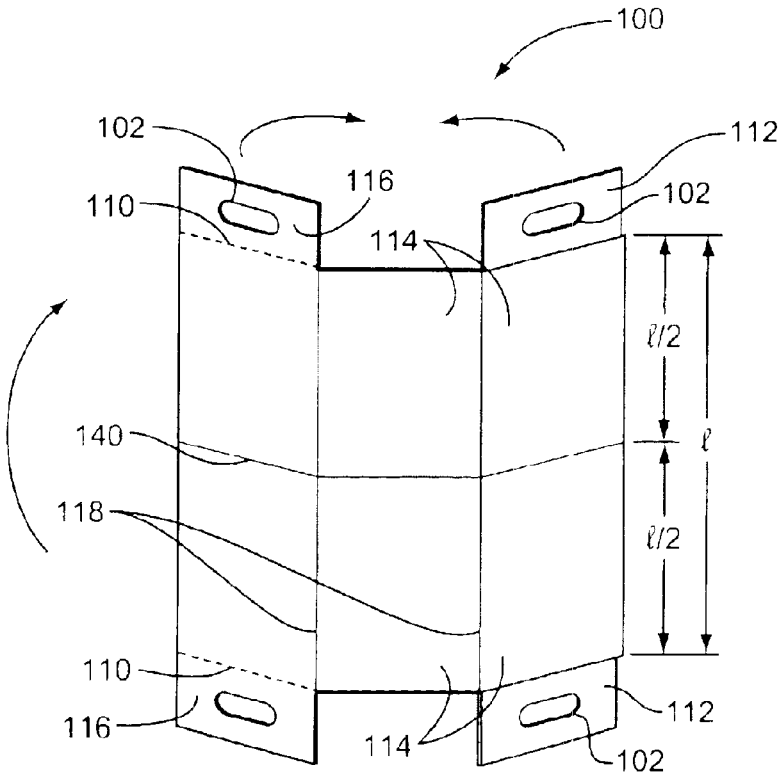
FIG. 4 illustrates present invention being folded along two vertical axes and a horizontal axis.
Figure 5:
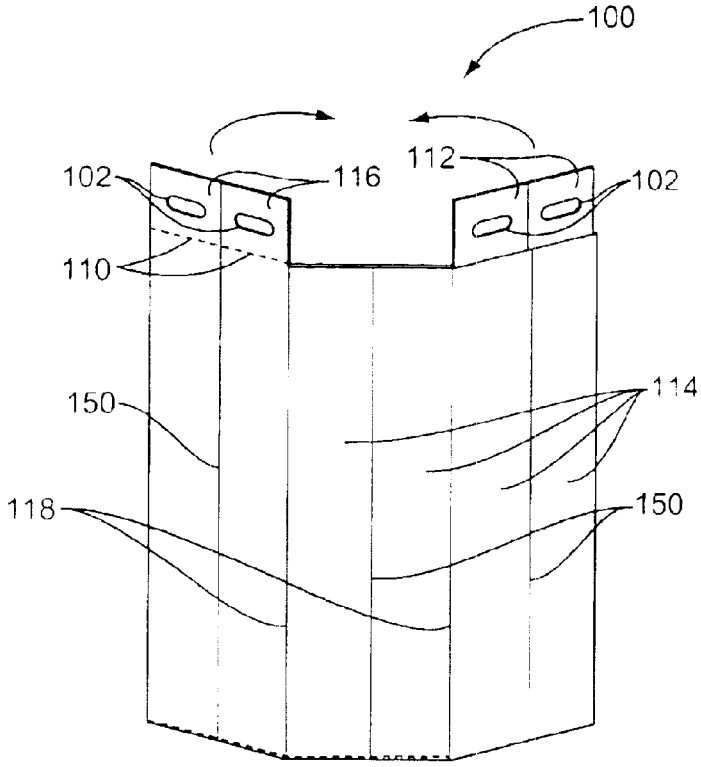
FIG. 5 illustrates the present invention being folded three times along three vertical axes.

Another embodiment of the present invention is illustrated in FIG. 4. In this embodiment, the bag insert 100 is capable of being folded along the vertical axes 118 and a horizontal axis 140. In addition, the bag insert 100 has handles 102 on both top and bottom of the sides 112 and 116. Further, the sides 110 and 114 have a length such that when folded, the handles 102 align with each other in an unobstructed manner. In another embodiment, the sides 110 and 114 may be the same length as the sides 112 and 116. The bag insert 100 may also have additional handles oriented such that when folded, the handles 102 and additional handles align with each other. The bag insert's 100 ability to be folded along the vertical axes 118 and the horizontal axis 140 allows additional maneuverability of the bag insert 100 and a smaller size when folded for ease of storage. Yet another embodiment of the present invention is illustrated in FIG. 5. In this embodiment, the bag insert 100 is capable of being folded along the vertical axes 118 and an additional vertical axis 150. The additional vertical axis 150 is located on sides 112 and 116. The sides 112 and 116 both have two handles 102, thereby giving the bag insert 100 a total of four handles. Again, the sides 110 and 114 have lengths such that the handles 102 are unobstructed when the bag insert 100 is folded. In order to be folded along all of the vertical axes, the bag insert 100 is first collapsed. Then, the bag insert 100 is folded along the vertical axes 118. The handles 102 on the sides 112 and 116 are aligned and unobstructed. The bag insert 100 is then folded for the second time along the additional vertical axis 150 between the handles 102 on the sides 112 and 116. This embodiment would be convenient for large yard waste collection bags 104, which would require the bag insert 100 to be much wider and possibly longer. Therefore, the second fold would reduce the bag insert 100 to a much more convenient size allowing for easy maneuvering and storage.

Figure 6:
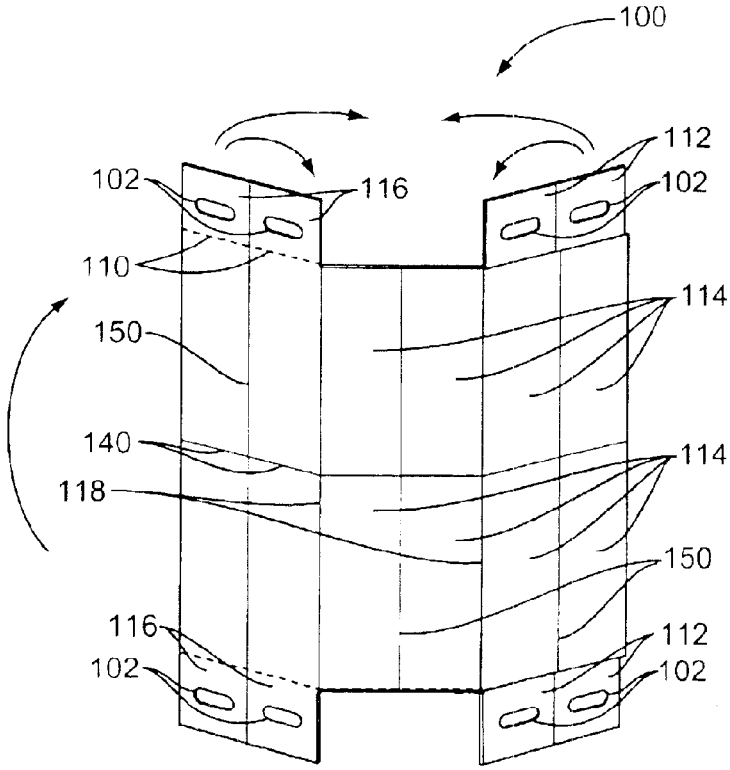
FIG. 6 illustrates the present invention being folded three times along three vertical axes and once along a horizontal axis.

FIG. 6 illustrates a combination of the embodiments illustrated in FIGS. 4 and 5. The bag insert 100 is capable of being folded along the vertical axes 118, the horizontal axis 140, and the additional vertical axis 150. In this embodiment, the bag insert 100 has eight handles 102. Two handles 102 are located at the top and the bottom of the sides 112 and 116. The handles 102 are oriented such that when folded they will align with each other. Further, the sides 110 and 114 have lengths such that the handles 102 will be unobstructed when folded. In addition to the steps described in the discussion of FIG. 5, the bag insert 100 is folded along the horizontal axis 140 found at a distance substantially equal to half of the length of the sides 112 and 116 from the top or bottom of the sides 112 and 116. Again, this embodiment would be convenient for large yard waste collection bags 104, which would require the bag insert 100 to be much wider and possibly longer. Further, this embodiment would minimize the overall size of the bag insert 100 during storage or packaging for sale.

Figure 7:
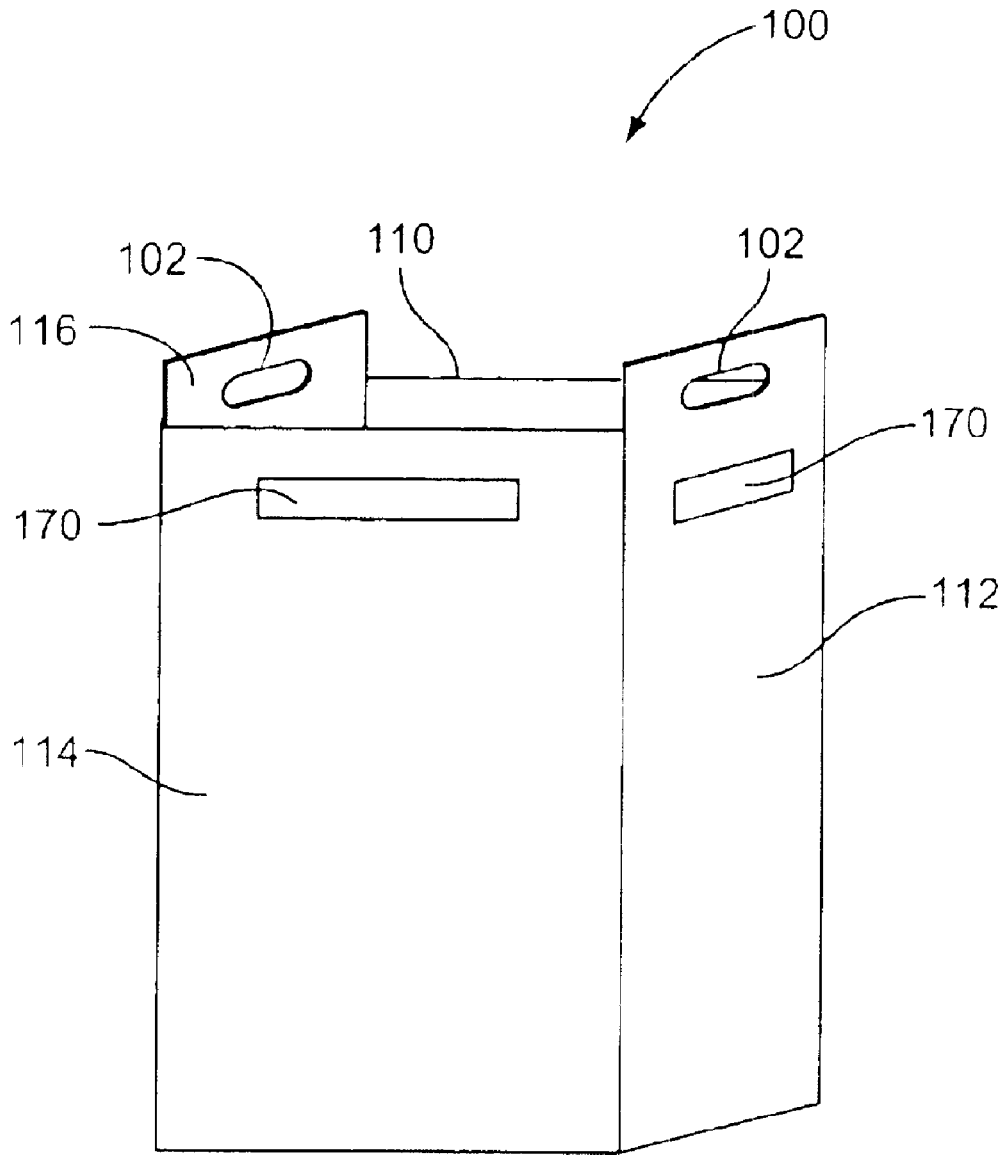
FIG. 7 illustrates the present invention with an additional attachment.

In FIG. 7, an additional, but not necessary, feature of the present invention is illustrated. The shape of the present invention is preferably rectangular by nature. In a situation where a yard collection bag 104 is not also rectangular shaped, the bag 104 may not remain fixed to the sides of the bag insert 100. In this case, it would be desirable to have attachments 170 on any or all of sides 110, 112, 114, and 116, such as any type of hook or adhesive, in order to temporarily attach the bag 104 to the bag insert 100.

Figure 8:
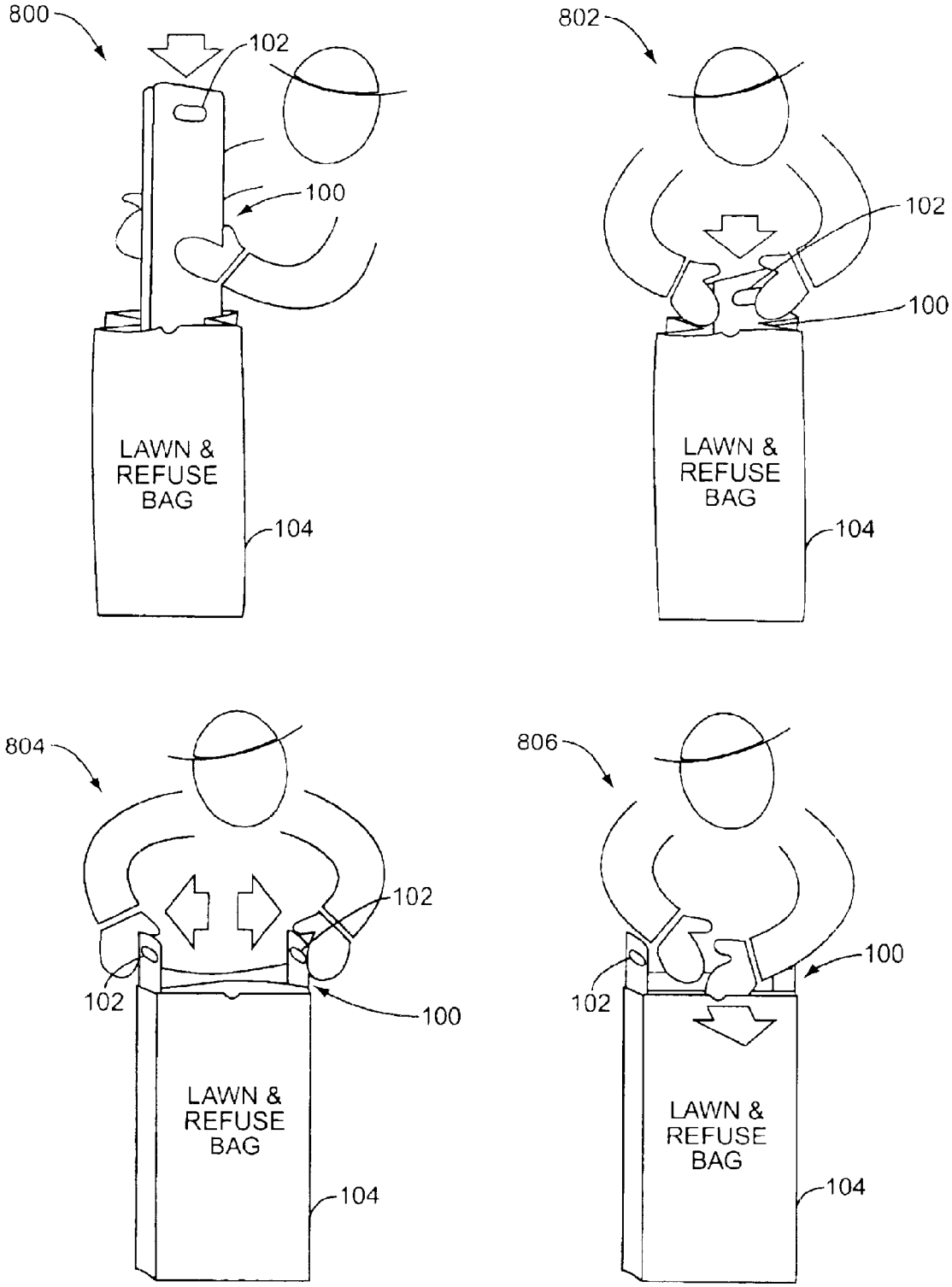
FIG. 8 illustrates the process on how to insert the bag insert into a collection bag.

FIG. 8 illustrates a process of how to insert the bag insert 100 into the waste collection bag 104. First, the folded bag insert 100 is inserted into the waste collection bag 104 (step 800). Preferably, the waste collection bag 104 is empty at this point. Next, the bag insert 100 is slid to the bottom of the waste collection bag 104 (step 802) and expanded within the waste collection bag 104 in order to form a hollow tube through which waste can be placed into the waste collection bag 104 (steps 804 and 806). In one embodiment, step 804 includes grasping the handles 102 and moving the handles 102 opposite directions away from each other perpendicular to the sides 112 and 116, thereby unfolding the bag insert 100. Step 806 includes fully expanding the bag insert 100 by fully extending sides 110 and 114. Other embodiments of the bag insert 100 may be expanded in steps 804 and 806 in a similar fashion. Although the process of FIG. 8 illustrates the bag insert 100 according to one embodiment, this process is applicable to any embodiment of the bag insert 100.

Figure 9:
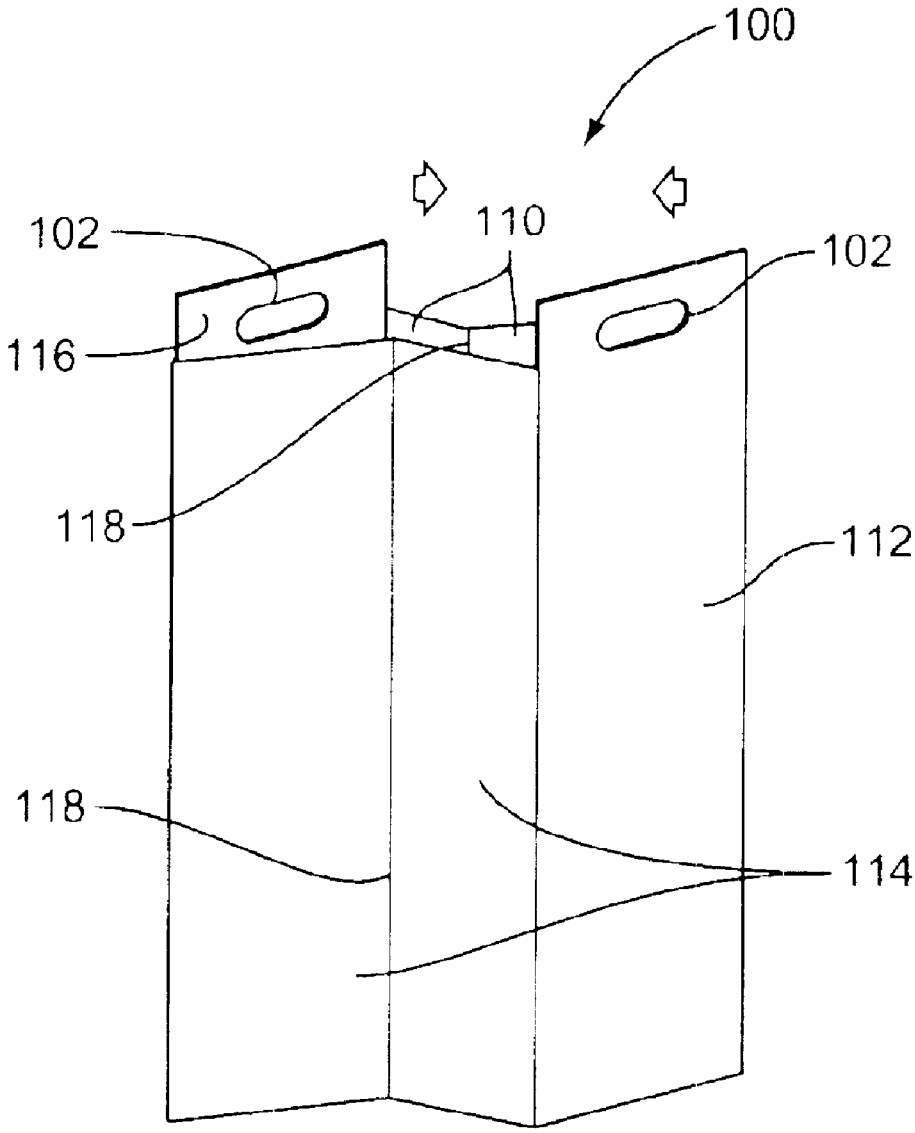
FIG. 9 illustrates the embodiment of the bag insert used in the process illustrated in FIG. 8.

FIG. 9 more clearly illustrates the embodiment of the bag insert 100 illustrated in steps 804 and 806 of FIG. 8. In this embodiment, the bag insert 100 has vertical axes 118 located on sides 110 and 114, wherein the sides 110 and 114 may be folded inwardly to collapse the bag insert 100 such that sides 112 and 116 are moved towards one another and the handles 102 are aligned for ease of handling, storage, and/or transport. In a similar fashion, the bag insert 100 may be expanded by moving the handles 102 away from one another in a direction perpendicular to sides 112 and 116.

Figure 10:
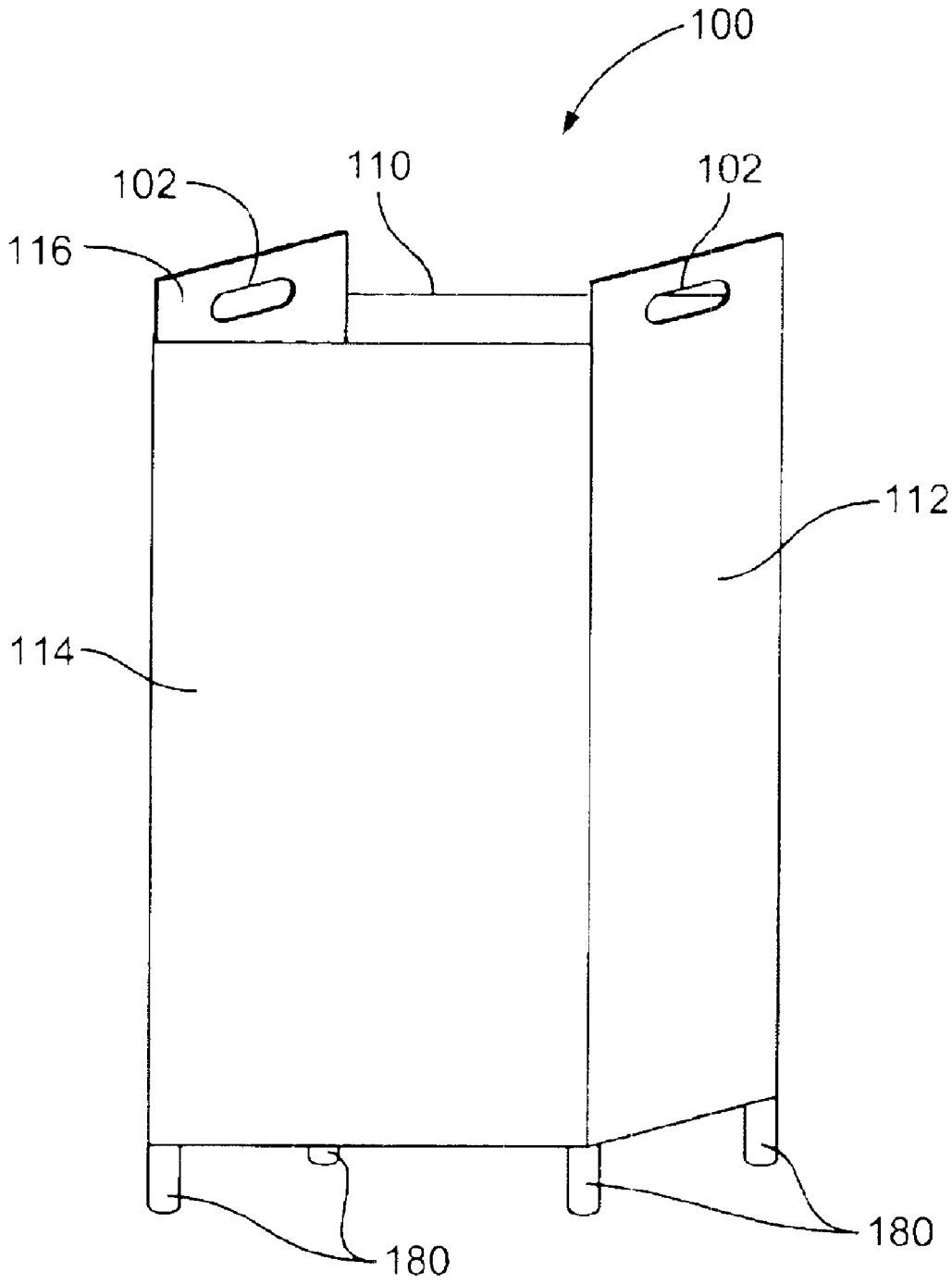
FIG. 10 illustrates an alternative embodiment of the bag insert having pegs for stability.

FIG. 10 illustrates another embodiment of the bag insert 100, wherein the bag insert 100 further includes pegs 180. The pegs 180 can be used to anchor the bag insert 100 into the ground. The pegs 180 may be made of wood, metal, cardboard, or any other type of rigid material that can support the weight of the bag insert 100 and collection bag 104. When not inserted into the ground, the pegs 180 provide improved stability by distributing the weight of the bag insert 100 and the collection bag 104, if any, on each of the pegs 180. Preferably, one of the pegs 180 is attached to each bottom corner of the bag insert 100. However, the bag insert 100 may include any number of pegs 180 located at various locations along bottom of the sides 110, 112, 114, and 116. In addition, it is to be recognized that any embodiment of the bag insert 100 disclosed herein may optionally include the pegs 180.

Figure 11:
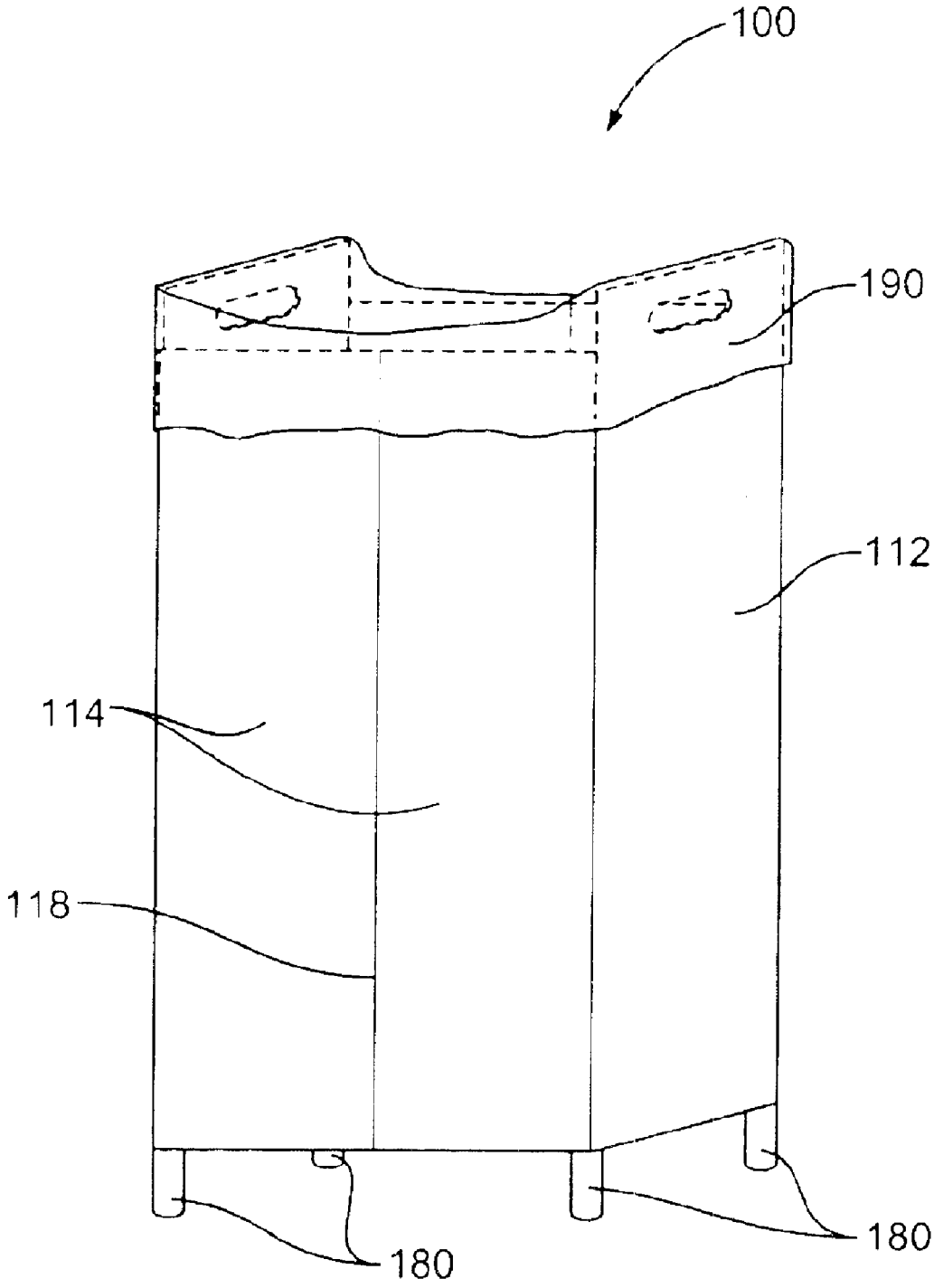
FIG. 11 illustrates a waste collection bag inserted within the bag insert according to another embodiment of the present invention.

FIG. 11 illustrates a waste collection bag 190 disposed within the bag insert 100. The bag insert 100 is expanded with the waste collection bag 190 disposed within the bag insert 100. When expanded, the bag insert 100 holds the bag 190 in a substantially open position, wherein the bag 190 can be folded over the handles 102 and top edges of sides 110 and 114 in a partially or fully open position. Preferably, the length of the bag insert 100 is substantially equal to or greater than the length of the waste collection bag 190, and is therefore capable of stabilizing the bag 190 in the upright open position during use. Further, by having a length substantially equal to or greater than the length of the waste collection bag 190, the bag insert 100 allows the bag 190 to be filled with a maximum amount of waste. However, the bag insert 100 may have any length. In order to remove the bag 190 from the bag insert 100, the bag 190 will be simply lifted upward and directly out, easily sliding out of the bag insert 100. The handles 102 provide a convenient way for the bag insert 100 to be carried, expanded, or folded.

Although the embodiment illustrated in FIG. 11 also uses the bag insert 100 described above, the bag insert 100 of FIG. 111 is not inserted into the waste collection bag 190. Instead, the waste collection bag 190 is inserted into the bag insert 100. Therefore, even though the bag insert 100 of this embodiment is termed as an "insert", the bag insert 100 is not actually inserted into the waste collection bag 190. In addition, the description of the bag insert 100 given above is equally applicable to the embodiment of FIG. 11. For example, as stated above, the bag insert 100 may optionally include the pegs 180 to improve stability by anchoring the bag insert 100 into the ground or distributing the weight of the bag insert 100 and waste collection bag 190 on each of the pegs 180.

Figure 12:
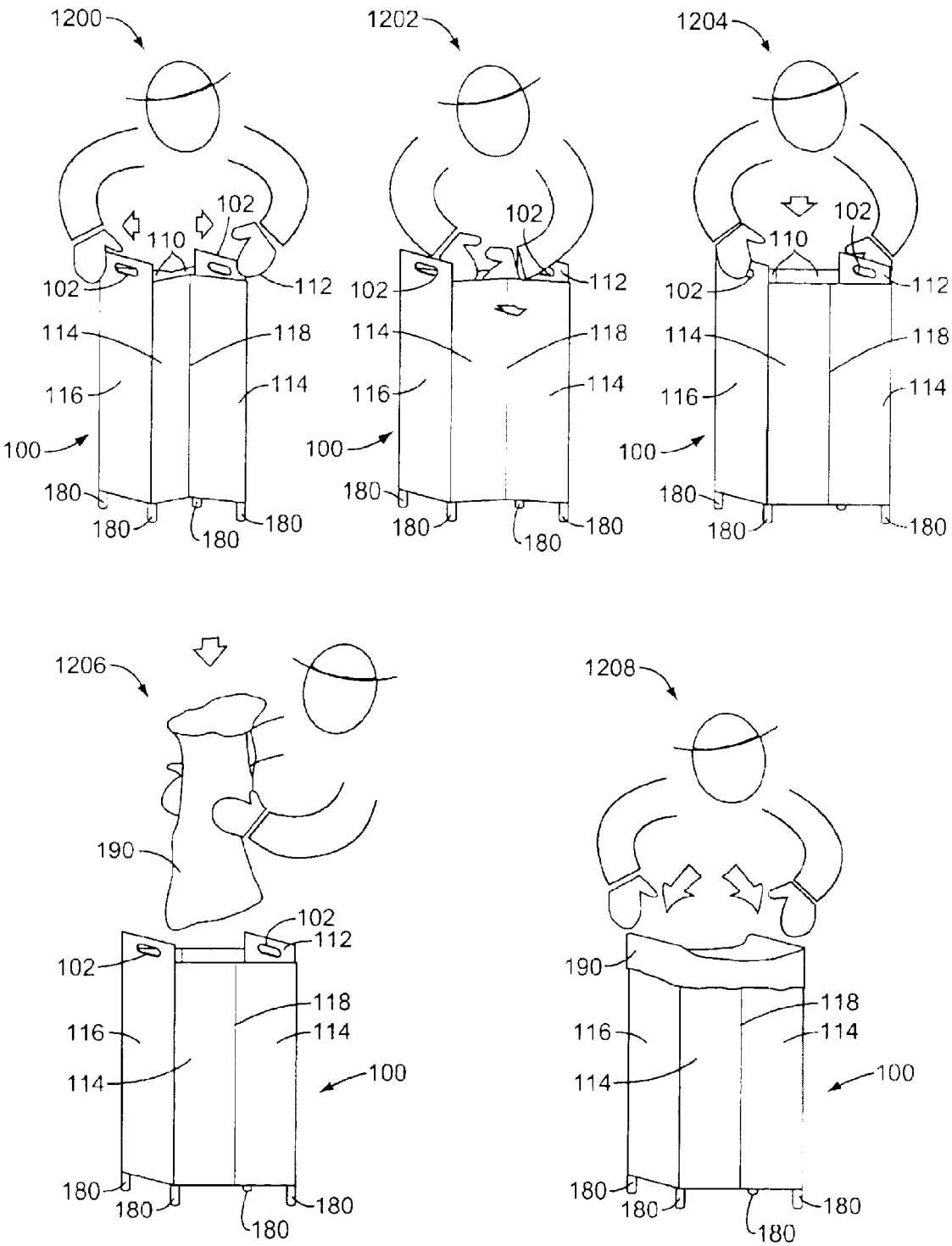
FIG. 12 illustrates a process on how to use the bag insert as the waste collection bag supporting apparatus of FIG. 11.

FIG. 12 illustrates a process of inserting the waste collection bag 190 into the bag insert 100 for the embodiment illustrated in FIG. 11. First, the bag insert 100 is expanded (steps 1200–1202), as described above regarding steps 804 and 806 of FIG. 8. Optionally, the bag insert 100 may include pegs 180 and be anchored into the ground via pegs 180 (step 1204). Next, the waste collection bag 190 is inserted into the bag insert 100 (step 1206), and an open end of the waste collection bag 190 is folded over the handles 102 and sides 110 and 114 (1208), thereby securing the waste collection bag 190 in an open state to the bag insert 100.

Figure 13A:
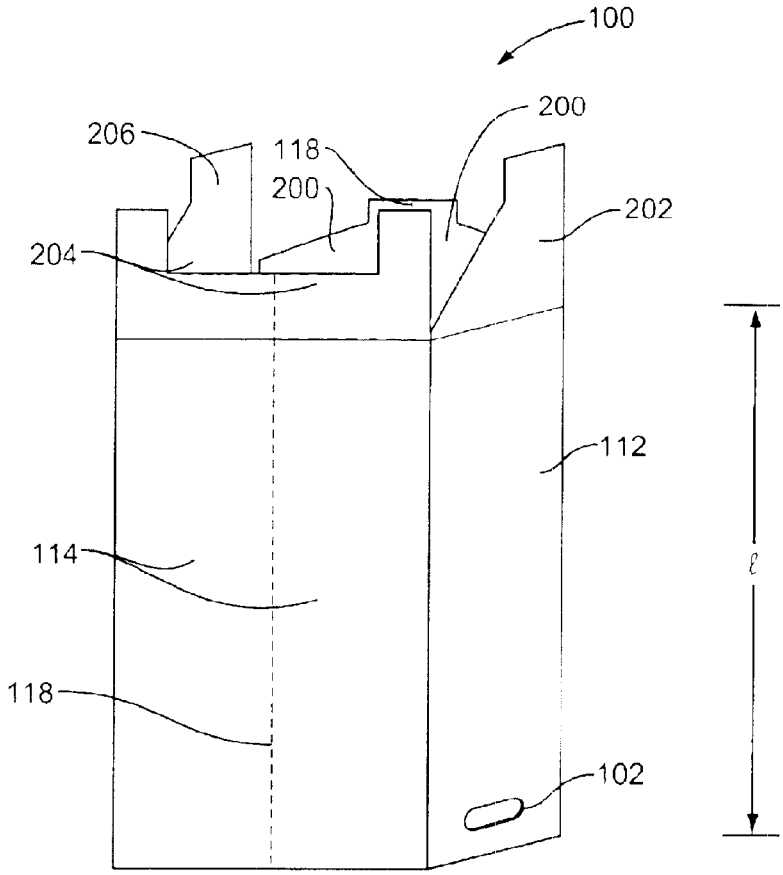
FIGS. 13A–13B illustrate an embodiment of the bag insert having a folding bottom.
Figure 13B:
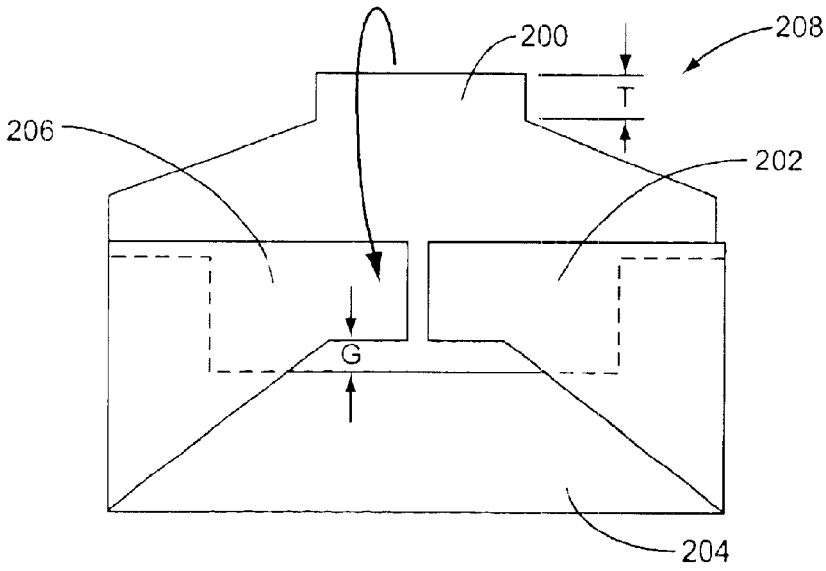

FIGS. 13A–13B illustrate another embodiment of the bag insert 100, wherein the bag insert 100 further includes first, second, third, and fourth folding bottom members 200–206, which can be folded to form a bottom side 208 of the bag insert 100. When expanded, the bottom members 200–206 form extensions of sides 110–116, respectively, wherein the sides 110–116 including the bottom members 200–206 may be folded in any of the various manners described above in order to reduce the size of the bag insert 100. In the illustrated embodiment, the lengths t of sides 110–116 are equal, thereby providing additional stability when folding the bottom members 200–206. However, sides 112 and 116 may have lengths greater than the length of sides 110 and 114, as described above.

FIG. 13B illustrates the folding of the bottom members 200–206 to form the bottom side 208 of the bag insert 100. To form the bottom side 208, the third bottom member 204 is first folded inwardly such that the third bottom member 204 is essentially perpendicular to the third side 114. The second and fourth bottom members 202 and 206 are then folded inwardly such that second and fourth bottom members 202 and 206 extend over the third bottom member 204 and are essentially perpendicular to sides 112 and 116, respectively. The first bottom member 200 is then folded to insert a tongue T of the first bottom member 200 through a gap G defined by bottom members 202–206. By inserting the tongue T through the gap B, the bottom members 200–206 are secured together, thereby forming the bottom side 208 of the bag insert 100. It should also be noted that the shape of the first bottom member 200 is such that the first bottom member 200 extends over second and fourth bottom members 202 and 206, which extend over the third bottom member 204.

Figure 14:
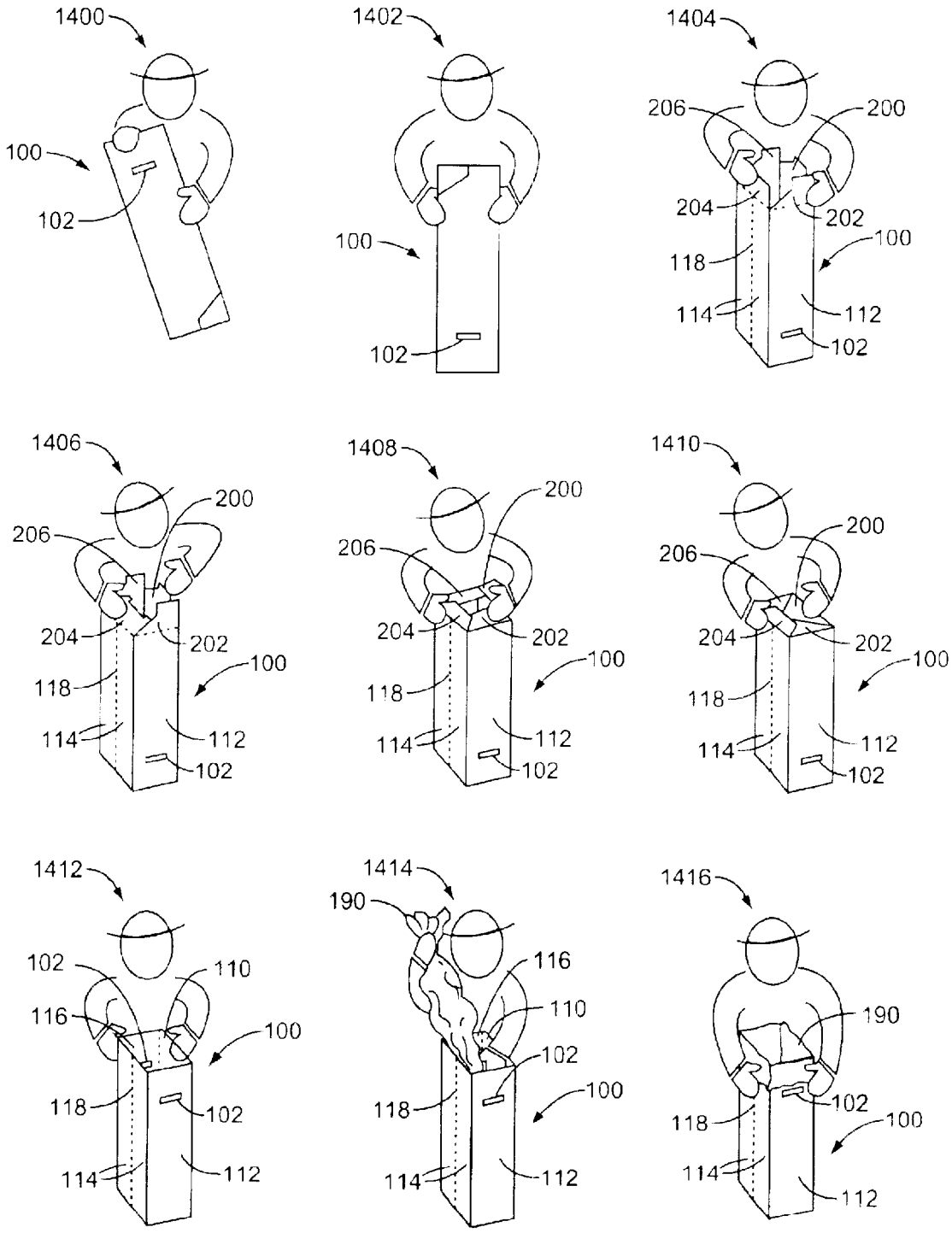
FIG. 14 illustrates a process on how to use the bag insert having a folding bottom of FIGS. 13A–13B.

FIG. 14 illustrates a process of inserting the waste collection bag 190 into the bag insert of FIGS. 13A and 13B. First, the bag insert 100 is turned upside-down such that the bottom members 200–206 are facing upward (steps 1400–1402). Next, the bag insert 100 is expanded (steps 1404), as described above regarding steps 804 and 806 of FIG. 8. The bottom members 200–206 are then folded (steps 1406–1410), thereby forming the bottom side 208. More specifically, the bottom side 208 is formed by first folding the third bottom member 204 (step 1406), then folding second and fourth bottom members 202 and 206 (step 1408), and then folding the first bottom member 200 and securing the tongue T of the first bottom member 200 under the third bottom member 204 (step 1410). The bag insert 100 is then placed in an upright position (step 1412), and the waste collection bag 190 is inserted into the bag insert 100 (step 1414), and an open end of the waste collection bag 190 is folded over the handles 102 and sides 110 and 114 (1416), thereby securing the waste collection bag 190 in an open state to the bag insert 100.

Similarly to the embodiments of FIGS. 10–12, even though the bag insert 100 of the embodiment illustrated in FIGS. 13A–13B and 14 is termed as an "insert", the bag insert 100 is not actually inserted into the waste collection bag 190. In addition, the description of the bag insert 100 given above is equally applicable to the embodiment of FIG. 13. For example, as stated above, the bag insert 100 may optionally include the pegs 180 to improve stability by anchoring the bag insert 100 into the ground or distributing the weight of the bag insert 100 and waste collection bag 190 on each of the pegs 180.

The bag insert 100 of the present invention offers substantial opportunity for variation without departing from the spirit and scope of the invention. For example, the sides 110 and 114 of the bag insert 100 may have lengths substantially equal to the lengths of the sides 112 and 116. In this case, the sides 110 and 114 would include additional handles 102 located such that they align with the other handles 102 when the bag insert 100 is folded. Further, the bag insert 100 of the present invention should not be limited to having four sides only. The bag insert 100 could have two or three sides and still not depart from the spirit or scope of the present invention. Additionally, the bag insert 100 may be manufactured in various materials comprising cardboard, recycled paper, and plastic. As another example, the bag insert 100 of the present invention could have embodiments having varying lengths and widths in order to accommodate various yard waste collection bags 104/190, each having a different width, length, or circumference. Further, while the embodiment of the bag insert 100 disclosed has a length being substantially equal to or greater than the length of the yard waste collection bag 104/190, the length of the bag insert 100 could be less than the length of the yard waste collection bag 104/190 and should be considered within the spirit and scope of the present invention.

Many more variations of the bag insert 100 of the present invention could be realized by the width of sides 110 and 114 being integer multiples of the width of sides 112 and 116. In this case, the bag insert 100 could be folded around a number of vertical axes equal to the ratio of the width of sides 110 and 114 to the width of sides 112 and 116. For example, sides 110 and 114 could have a width equal to 3 times the width of sides 112 and 116. In this example, the bag insert 100 may still have only two handles 102. In order to align the handles, the bag insert 100 of this example would be folded along one vertical axis at either the intersection of sides 114 and 116 or at the intersection of 112 and 114. The bag insert 100 would again be folded along vertical axes found at twice the width of sides 112 and 116 and at three times the width of 112 and 116 from the edge of side 114. Another example is that the bag insert 100 could be a perfect square. In this case, the bag insert 100 would have a vertical axis at the intersection of sides 114 and 116 around which the bag insert 100 could be folded in order to align the handles 102 and reduce the size for storage and packaging.

The embodiments disclosed thus far have all had sides 110 and 114 having a width equal to integer multiples of the width of sides 112 and 116. However, the bag insert 100 could have sides of any width. Therefore, the vertical axes needed to align the handles 102 would vary in location, and should, indeed, be considered within the spirit and scope of the present invention.

The foregoing details should, in all respects, be considered as exemplary rather than as limiting. The present invention allows significant flexibility in terms of implementation and operation. Examples of such variation are discussed in some detail above; however, such examples should not be construed as limiting the range of variations falling within the scope of the present invention.

What is claimed is:

1. A method of placing waste collection into a collection bag comprising:

inserting a folded bag insert into a collection bag, said bag insert comprising:

i) a first side having a first handle located at an upper portion of said first side;

ii) a second side foldably connected to said first side;

iii) a third side foldably connected to said second side, and having a second handle located at an upper portion of said third side;

iv) a fourth side foldably connected to said first and said third side; and v) one or more pegs at a bottom of said bag insert;

when folded, said first, second, third, and fourth sides are folded about one or more axes, thereby substantially aligning said first and second handles and reducing the size of said lawn bag insert;

expanding said bag insert inside said collection bag, thereby forming a hollow structure supporting said collection bag; and anchoring said bag insert into the ground by applying force to said bag insert, thereby forcing said one or more pegs into the ground.

2. The method of claim 1 wherein said step of expanding comprises unfolding said first, second, third, and fourth sides about said one or more axes.

3. The method of claim 1 wherein said step of inserting comprises grasping said first and second handles, placing said bag insert into said collection bag, and sliding said bag insert to the bottom of said collection bag.

4. A method of placing waste collection into a collection bag comprising:

expanding a folded bag insert, thereby forming a hollow structure to support a waste collection bag, said bag insert comprising:

i) a first side having a first handle located at an upper portion of said first side;

ii) a second side foldably connected to said first side;

iii) a third side foldably connected to said second side, and having a second handle located at an upper portion of said third side;

iv) a fourth side foldably connected to said first and said third side; and v) one or more pegs at a bottom of said bag insert;

when folded, said first, second, third, and fourth sides are folded about one or more axes, thereby substantially aligning said first and second handles and reducing the size of said lawn bag insert;

inserting a waste collection bag into said bag insert; and anchoring said bag insert into the ground by applying force to said bag insert, thereby forcing said one or more pegs into the ground.

5. The method of said claim 4 wherein said step of expanding comprises unfolding said first, second, third, and fourth sides about said one or more axes.

6. The method of claim 4 wherein said step of inserting comprises grasping said waste collection bag, placing said waste collection bag into said bag insert, and folding an open end of said waste collection bag over said first, second, third, and fourth sides.

7. The method of claim 4 wherein said bag insert further comprises four or more pegs at a bottom of said bag insert, said method further comprising anchoring said insert into the ground by applying force to said insert, thereby forcing said pegs into the ground.

8. The method of claim 4 wherein the bag insert further comprises a first foldable bottom member foldably attached to said first side, a second foldable bottom member foldably attached to said second side, a third foldable bottom member foldably attached to said third side, and a fourth foldable bottom member foldably attached to said fourth side, and said method further comprises the step of folding said first, second, third, and fourth bottom members thereby forming a bottom side of said bag insert prior to said inserting step.

* * * * *